United States Patent [19]

Daisyaku

[11] 4,368,404

[45] Jan. 11, 1983

[54] MATRIX-TYPE FLUORESCENT DISPLAY DEVICE

[75] Inventor: Ikuo Daisyaku, Ueno, Japan

[73] Assignee: Chowa Giken Kabushiki-Kaisha, Mie, Japan

[21] Appl. No.: 179,294

[22] PCT Filed: Apr. 23, 1979

[86] PCT No.: PCT/JP79/00104

§ 371 Date: Dec. 13, 1979

§ 102(e) Date: Dec. 13, 1979

[51] Int. Cl.[3] ..... H01J 63/02

[52] U.S. Cl. ..... 313/497

[58] Field of Search ..... 313/495, 496, 497, 422

[56] References Cited

U.S. PATENT DOCUMENTS

| | | | |
|---|---|---|---|
| 2,500,929 | 3/1950 | Chilowsky | 313/2 X |
| 2,926,286 | 2/1960 | Skellett | 313/495 X |
| 2,965,801 | 12/1960 | Archer et al. | 313/422 X |
| 3,136,911 | 6/1964 | Crawford et al. | 313/496 |
| 3,509,402 | 4/1970 | DuBois, Jr. et al. | 313/497 |
| 3,566,187 | 2/1971 | DuBois, Jr. | 313/485 X |
| 3,800,178 | 3/1974 | Farina | 313/497 |
| 3,806,760 | 4/1974 | Shimada | 313/487 X |
| 4,075,535 | 2/1978 | Genequand et al. | 313/422 |

FOREIGN PATENT DOCUMENTS

| | | | |
|---|---|---|---|
| 52-53657 | 4/1977 | Japan | 313/496 |

*Primary Examiner*—Palmer C. Demeo
*Attorney, Agent, or Firm*—Carroll F. Palmer

[57] ABSTRACT

This invention is related to a matrix-type fluorescent indicator lamp which is formed of a matrix by making a number of grid thin wires 13 arranged in parallel intersect perpendicular to a number of anode thin wires 11 arranged in parallel within a sealed tube being composed of a glass cover 6 and an insulated substrate 8, and which displays characters and figures as a dotted pattern by making the fluorescent material-applied anode thin wires luminous spot-like where the anode thin wires 11 intersect the grid thin wires 13. In the lamp, said anode thin wires 11 are mutually arranged in parallel not being in contact with the insulated substrate 8 so as to densify luminous spots narrowing the pitch between the anode thin wires 11 arranged in parallel.

11 Claims, 9 Drawing Figures

MATRIX-TYPE FLUORESCENT DISPLAY DEVICE

DESCRIPTION

1. Technical Field

This invention relates to a matrix-type fluorescent indicator lamp which is composed of a matrix with a number of anode thin wires stretched in latitudinal arrangement between wire supporting bodies and a number of grid thin wires stretched in longitudinal arrangement across supporting members spaced mutually, and which receives thermoelectrons emitted from cathode filaments at the anode thin wires to which fluorescent material is applied where the anode thin wires intersect the grid thin wires in the matrix to make luminous so as to display characters, signs and figures selectively as a dotted pattern.

2. Background Art

Fluorescent indicator lamps which indicate characters, signs, figures employing fluorescent material which illuminates when impinged by electrons are in prior art. Also it is known that these lamps are used to show data with characters or signs in various control devices or information processors.

For example, Japanese Patent publication No. 45-20223 shows one type of conventional fluorescent indicator tube. Here a plurality of picture elements required to show characters (0) to (9) with a line-pattern are previously so drawn on an insulated base using fluorescent material that desired characters can be displayed by supplying a positive voltage to select one or more picture element on the base. This type of the lamp has disadvantage that the number of characters which can be selectively displayed is limited.

Another type of conventional fluorescent indicator lamp is a matrix type in which fluorescent material is discretely distributed in longitudinal and latitudinal directions to display desired characters or signs as luminous spots.

Such lamps as mentioned above have the advantage that many sorts of characters or signs can be selectively displayed. In this type of lamp, however, because of low distribution density of luminous spots, a dotted pattern that is a set of luminous spots becomes unclear, particularly for smaller size of characters or signs or complicated figures. This means that the resolving power is low, therefore such lamps is not suitable to display figures such as graphs, without an expensive CRT.

Constitution of the above-mentioned conventional matrix-type fluorescent indicator lamps which display characters or signs with a dotted pattern is as follows:

A number of grid thin wires are arranged in parallel within a discharge space of the indicator lamp. A number of anode thin wires which are perpendicular to the grid thin wires so as to substantially constitute a matrix are arranged in parallel on upper surface of a board by printed circuit means. Then the upper surface of the printed circuit is covered by an insulated layer so that the anode thin wires are enveloped. Small holes are so formed in the insulated layer at the intersections in the matrix and fluorescent material is applied to the holes to be luminous spots with the anode thin wires being conductive to the fluorescent material. If the distance between the anode thin wires is diminished to densify the luminous spot, distance required to secure insulation between the wires is shortened enough to cause an electric leakage.

Accordingly, it is a general object of this invention to provide a matrix-type fluorescent indicator lamp which can display smaller characters, signs including bigger ones clear-cut and which moreover is suitable to display graphs or complicated figures and which permits color displays with two or more than two colors combined or with one of the colors selected as a result of densifying the luminous spot.

DISCLOSURE OF INVENTION

The present invention is characterized in that a number of anode thin wires, which are arranged in parallel to form a matrix with a number of grid thin wires arranged in parallel within a vacuum space being composed of a wall and an insulated substrate opposing to the wall, at least either of which is light-passable, are located with a certain distance spaced from the surface of the substrate.

This results in each of the anode thin wires being separated within the vacuum space. Diminishing the distance sufficiently between the wires is less liable to cause an electric leakage.

In this invention I create, a number of display luminous spots to fluoresce on the fluorescent-applied anode thin wires which can be arranged in parallel with minimum possible distance spaced mutually at the intersections in the matrix. The luminous spot can be densified by such easier operation as narrowing the mutual distance between the anode thin wires. High density of luminous spots (a high resolving power) as a dotted pattern can display smaller characters, signs including bigger ones clear-cut and at the same time enables it appropriate to display graphs and figures which are preferably displayed by continous dots.

Furthermore it is possible to display them with two or more than two colors combined or with one of the colors selected by forming plural picture elements within one luminous spot which is composed of at least, two thin anode wires sufficiently approached mutually and one thin grid wire, while fluorescent materials which fluoresce differently are applied to each of the anode thin wires.

BRIEF DESCRIPTION OF DRAWINGS

In the accompanying drawings, are preferred embodiments of a matrix-type fluorescent indicator lamp according to the present invention, however, scale ratio in respect to various parts of the indicator lamp in the drawings is shown enlarged to be understood with ease.

In the drawings.

DESCRIPTION OF PREFERRED EMBODIMENTS

Figure 1:
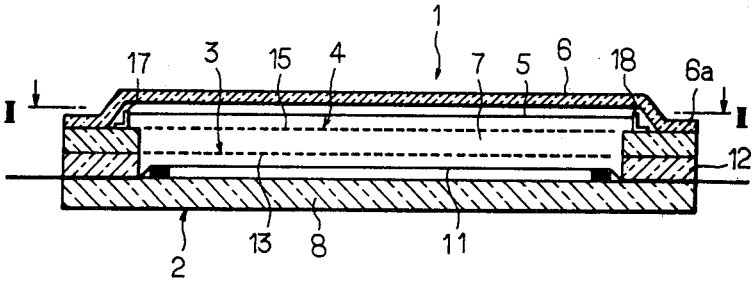
FIG. 1 is a vertical sectional view of a matrix-type fluorescent indicator lamp as an embodiment of the present invention.

Further details of the present invention are described below with attached drawings referred to.

Referring to FIGS. 1 to 7, a matrix-type fluorescent indicator lamp 1 according to the invention is divided into an anode thin wire unit 2, a grid thin wire unit 3, a diffusion grid unit 4, cathode filaments 5, and a glass cover 6 which constitutes a light-passable wall.

The anode thin wire unit 2 has an insulated substrate 8 to form a discharge space with said glass cover 6. Wire supporting members 9, 10 are arranged in parallel mutually on the right and left ends of the upper face of the substrate 8 as shown in the Figures and they are fixed thereon with a baked glass paste having a low melting point attached. A number of anode thin wires 11 are supported in parallel arrangement on the wire supporting member 9 and 10, with the baked glass paste having a low melting point attaching to the wires 11 and the wire supporting members 9 and 10.

Figure 4:
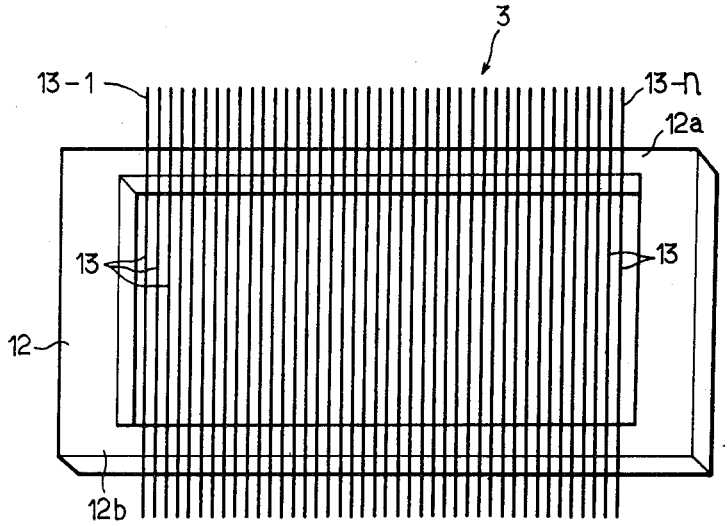
FIG. 4 is a perspective view of a grid thin wire unit in the indicator lamp.
Figure 6:
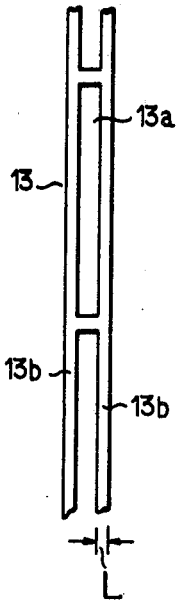
FIG. 6 is a fragmentary enlarged plan view of one grid thin wire in the indicator lamp.

In the above-mentioned manner, each anode thin wire is kept stretched tightly between the supporting members 9 and 10 with a certain distance spaced from the substrate 8. The anode thin wire 11 is an alloy of Ni (42%) and Cr (6%) with Fe as a main component. Each of the anode thin wires 11 is a long thin strip and each side of the wires 11 which faces in parallel with the substrate is for example $220\times10^{-9}$ m wide. The anode thin wires 11 are mutually spaced at a distance of 0.3 mm as a parallel arrangement pitch. Fluorescent material is continuously applied to each of the anode thin wires 11 which are between the wire supporting members 9 and 10 by means of for instance electrodeposition. Compound of ZnS and Ag as the above-mentioned fluorescent material illuminates blue, compound of Zn and ZnO green, and compound of $Zn_5(PO_4)_2$ and Mn red. The material may be applied in spaced-apart spots to the anode thin wires 11 as above mentioned at points of illumination as hereinafter described instead of being applied continuously. As shown in FIGS. 1 and 4, the grid thin wire unit 3 has a rectangular insulated frame 12 including sides 12*a* and 12*b* which are a mutually opposing pair of supporting blocks. A number of grid thin wires 13 are arranged in parallel and tightly stretched between both sides 12*a* and 12*b*. Each of the grid thin wires 13 is fixed on the face of the sides 12*a* and 12*b* with the baked glass paste having a low melting point attached. The grid thin wires 13 are determined the same as the anode thin wires 11 in both material and parallel arrangement pitch. As shown in FIG. 6, each of the grid thin wires 13 is a long thin strip with a number of lengthwise 13*a* to allow thermoelectrons to pass easier. Linear portions 13*b* form the outer sides of the slits 13*a* which are for example 0.03 mm wide.

Figure 5:
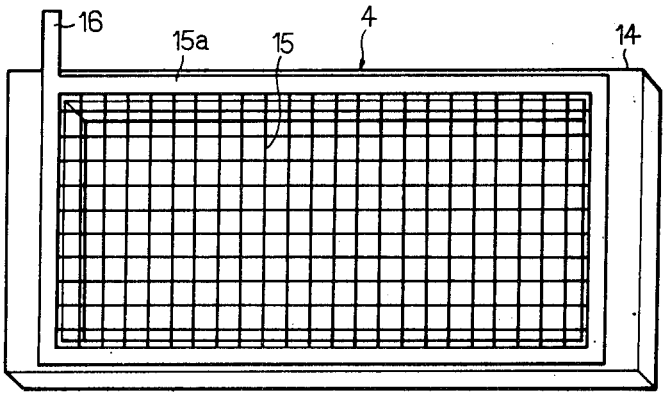
FIG. 5 is a perspective view of a diffusion grid unit in the indicator lamp.

Referring to FIG. 5, the diffusion grid unit 4 has a rectangular insulated frame 14. On a front side of the frame 14, is a diffusion grid 15 fixed which is a latticed or hexagonal net-like structure having a diameter of less than 0.03 mm and a side of around 0.5 mm. A feeder 15*a* which has an outer extended terminal 16 and is solid with the grid is fixed on the perimeter of the insulated frame 14.

Figure 2:
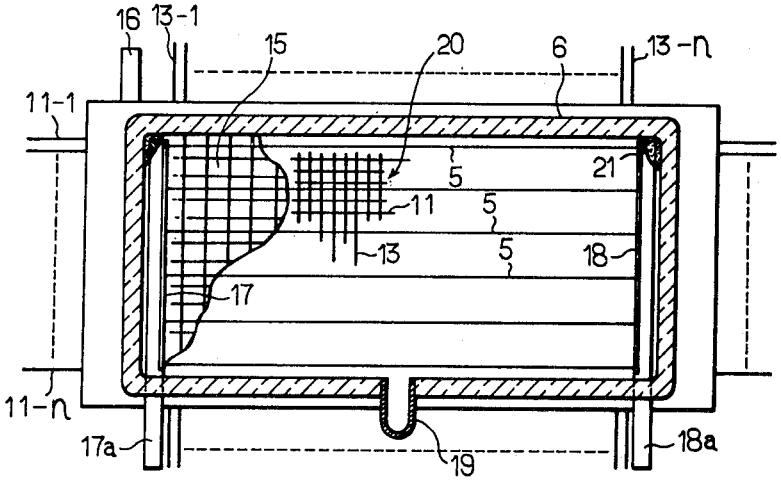
FIG. 2 is a cross-sectional view along section line II—II of FIG. 1.
Figure 3:
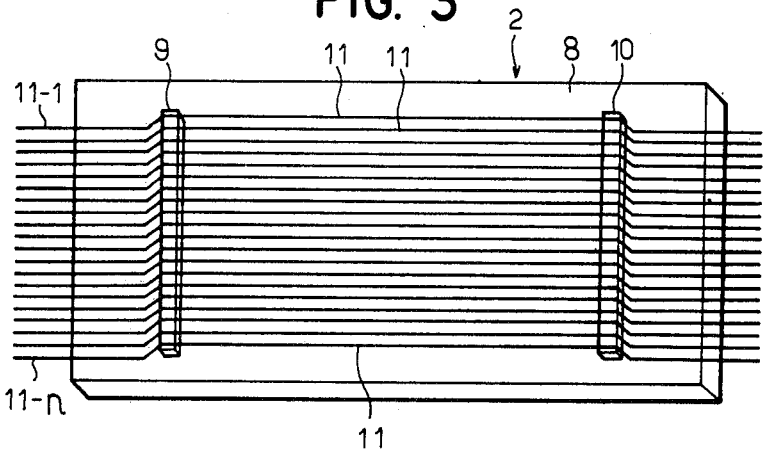
FIG. 3 is a perspective view of an insulated substrate which supports anode thin wires comprising the indicator lamp.

Referring to FIGS. 1 and 2, conductive supporting projections 17 and 18 are fixed near the right and left ends of the upper face of the insulated frame 14 with the baked glass paste attached, insulated from the feeder 15*a*. A number of cathode filaments 5 are mutually suspended in parallel between supporting projections 17 and 18. To each cathode filament having a diameter of 0.01 to 0.03 mm, a mixture of BaO, CaO, and SrO is applied. A conductive, transparent film is attached to the inner side of the glass cover 6 where light passes. A half baked glass having a low melting point is applied to the inner surface of the flange 6*a* of the glass cover 6. An exhaust pipe 19 having an inner diameter of around 5.0 mm is connected to the glass cover 6.

The indicator lamp 1 is assembled by piling the insulated frame 12 of the grid thin wire unit 3, the insulated frame 14 of the diffusion grid unit 4 and the glass cover 6 in turn on the insulated substrate 8 of the anode thin wire unit 2 for integration as shown in FIG. 1.

For the integration, each contacting surface of the above mentioned units is mutually adhered with a glass paste baked in a $N_2$ glass atmosphere. The resulting assembly is heated as far as 400 degree C. to vacuumize the discharge space 7 through the exhaust pipe 19. The cathode filaments are activated during the exhausting process, and after finishing the exhausting process the pipe 19 is cut by a gas burner and sealed. In the assembling process, as for the configuration of the grid thin wire unit 3 and the anode thin wire unit 2, the grid thin wires 13 are determined to intersect the anode thin wires 11 with a certain distance spaced to form a matrix 20 (only part of the matrix shown) as shown in the FIG. 2. Numeral 21 is the prior art getter in an electric tube. Also in the figure, numerals 11-1 to 11-n are terminal wires constituted by taking the anode thin wires 11 out of the tube, numerals 13-1 to 13-n are terminal wires constituted by taking the grid thin wires 13 out of the tube, and numerals 17*a* and 18*a* are terminals constituted respectively by taking a part of the supporting projections 17 and 18 out of the tube.

The indicator lamp 1 being in operation, the cathode filaments 5 are normally heated dark red with 4.5 V AC supplied, the diffusion grid 15 is normally supplied with a positive voltage of 30 V DC, thereby thermoelectrons emitted from the cathode filaments 5 are diffused all over the matrix 20 through the diffusion grid 15.

In the matrix where the anode thin wires 11 intersect the grid thin wires 13 there appear luminous spots. The spots don't illuminate when either of the two kinds of wires 11 and 13 is given for example −10 V but illuminate when both of the two kinds of wires 11 and 13 are given for example 65 V at once.

For example when a voltage which is supplied to an anode thin wire 11 conductible to the terminal wire 11-n and a grid thin wire 13 conductible to the terminal wire 13-n changes from −10 V to +65 V at once, thermoelectrons from the cathode filaments 5 are concentrated on one luminous spot which is an intersection of the above-mentioned two kinds of wires to make thermoelectrons shoot to the fluorescent-applied anode thin wire 11 positioned in the luminous spot to illuminate spot-like.

Figure 7:
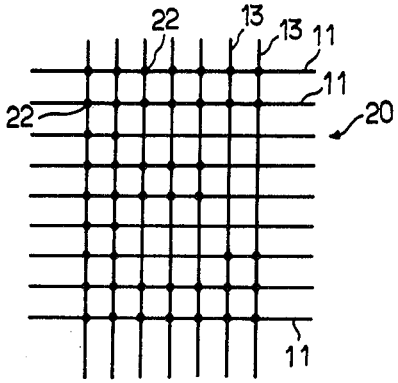
FIG. 7 is an enlarged view illustrating a displaying state of a matrix in the indicator lamp.

Accordingly, by selectively applying the positive voltage to the anode thin wires 11 and the grid thin wires 13 corresponding to characters, signs and figures to be displayed, they can be displayed as a dotted pattern. FIG. 7 shows an example displaying character (E) as a dotted pattern in the matrix 20. Black dots in FIG. 7 show luminous spots. Since a matrix drive principle for displaying characters or the like using the matrix 20 is not different from that of conventional matrix-type fluorescent indicator lamps, description of the driving circuit will be omitted here.

A remarkable feature of the present invention is that a number of the anode thin wires 11 arranged in parallel are supported above the insulated substrate 8 with the wires floated within the discharge space 7, not contacting with the surface of the insulated substrate 8, and fluorescent material is directly applied to the above-mentioned anode thin wires 11.

According to the invention, each of the anode thin wires 11 are insulated mutually within almost perfect vacuum space to prevent an electric leakage therebetween. This enables to narrow each distance among the anode thin wires 11 arranged in parallel sufficiently which means that a high dense dotted pattern (luminous spots in the matrix 20) can be secured. Such a high dense dotted pattern makes it possible to display characters and signs clear-cut even if they are small in size. This makes it suitable enough to display complicated figures, graphs, etc. which are preferably displayed with a high resolving power.

In addition, the anode thin wires 11 as the above mentioned embodiment are fixed to the upper surface of the wire supporting members 9 and 10 mounted on the insulated substrate 8 and they are embedded in the insulated material where they are fixed, and moreover a leakage distance between the anode thin wires 11 can be easily widen, therefore an electric surface seepage in the supporting portion can be securely prevented.

Figure 8:
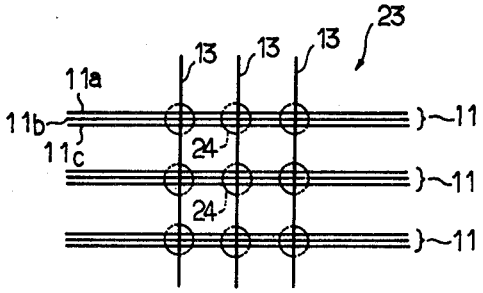
FIG. 8 is an enlarged view of a matrix of another embodiment of the invention.

FIG. 8 shows a matrix 23 of another embodiment of the present invention. This matrix 23 is so constituted as to form one luminous spot with one grid thin wire (or plural grid thin wires) and a unit number of anode thin wires. The anode thin wires 11 as a unit are divided into three wires 11*a*, 11*b*, 11*c* mutually approached sufficiently. To each of the three wires 11*a*, 11*b*, 11*c* are fluorescent material applied which illuminates differently as blue, green or red.

The embodiment of FIG. 8 can display a pattern with plural illuminating colors combined or with one illuminating color selected, because the three picture elements each of which illuminates differently exists within one luminous spot.

Such an embodiment as shown in FIG. 7 having one picture element with each thin wire 11 and 13 to form a luminous spot, can display a pattern the same as mentioned above with illuminating colors combined by applying different fluorescent material alternately to each anode thin wire 11 which forms a unit with one or plural wires.

Figure 9:
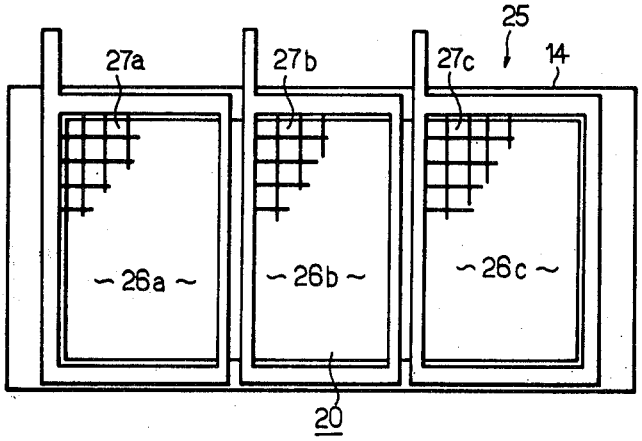
FIG. 9 is a plan view of a diffusion grid unit illustrating an example of the arrangement of another embodiment of the invention.

FIG. 9 shows a diffusion grid unit 25 of another embodiment of the present invention. This diffusion grid unit 25 comprises three-divided diffusion grids 27*a*, 27*b*, 27*c* supported on the insulated frame 14, for example when being desired to display three figures by the matrix 20 within an insulated frame 14, so that each figure-display-section 26*a*, 26*b*, 26*c* in the matrix 20 is intended to correspond to each diffusion grid 27*a*, 27*b*, 27*c*.

Polarity of a voltage which is supplied to each diffusion grid 27*a*, 27*b*, 27*c* can be selected independently.

The embodiment as shown in FIG. 9 can cease indicating a figure when a negative voltage is supplied to the diffusion grid corresponding to the figure-display-section desired to stop without giving voltage to the anode thin wire 11 and the grid thin wire 13 so as to stop the display. Application of electric circuit for giving a voltage for display to the anode thin wire unit 2 and the grid thin wire unit 3 will be simplified.

INDUSTRIAL APPLICABILITY

Above-mentioned matrix-type fluorescent indicator lamp related to the invention is available for indicating data as dott-patterned characters, signs, figures and graphs in various kind of control devices or information processors.

What is claimed is:

1. A matrix-type fluorescent dot display device which comprises:

a quadrilateral vacuum discharge space defined by a wall and an insulated substrate opposed to said wall, at least one of said wall and substrate being light-passable, the periphery of said wall being fixed by air-tight sealing means to the periphery of said substrate, an anode wire array within said discharge space comprising a multitude of thin wires stretched in a plane parallel to and spaced apart from one another, said array being devoid of transverse wires, a plurality of wire support members holding said wires of said array in said parallel, spaced apart position above and out of contact with said substrate, terminal means that extends outside said discharge space to connect the wires of said array to an electric voltage source, the wires of said array being at least partially coated with fluorescent material that will fluoresce when bombarded by thermoelectrons, cathode filaments positioned adjacent said wall within said discharge space provided with terminal means so said filaments may be electrically energized to emit thermoelectrons, an electrically conductive grid comprising a multitude of thin wires positioned between said array and said cathode filaments within said discharge space, said grid wires being stretched in a plane parallel to and spaced apart from one another and perpendicular to said wires of said array, said plane of said grid being spaced apart and parallel to said plane of said array, said grid being devoid of transverse wires, terminal means that extends outside said discharge space to connect the wires of said grid to an electric voltage source, said grid serving to create luminous dots on the wires of said array when the wires of said array are energized by a predetermined positive voltage and the wires of said grid are also energized by a predetermined positive voltage.

2. The display device of claim 1 that comprises an electron diffusion web positioned between said cathode filaments and said conductive grid within said discharge space, said web serving to diffuse thermoelectrons emitted from said cathode filaments.

3. The display device of claim 1 wherein said wall is made of glass.

4. The display device of claim 1 wherein some of the wires of said array are coated with fluorescent material that fluoresces in a first color and other of the wires of said array are coated with fluorescent material that fluoresces in a second different color.

5. The display device of claim 4 wherein said wires of said array are arranged in units of two or more wires that are less spaced apart from one another than the spacing between said units within the array and each of the wires in each said units are coated with fluorescent material that fluoresces in a color different from the color of fluorescence of the other wires in said unit.

6. The display device of claim 5 wherein said wire units of said array serve to create luminous spots at points of intersection thereof with wires of said grid upon being energized to said predetermined positive voltage.

7. The display device of claim 1 wherein said wires of said array are thin strips of greater width than thickness and said greater width is parallel to said plane of said array.

8. The display device of claim 7 wherein said wires of said grid are in the form of thin strips of greater width than thickness with central longitudinal slits therein of limited length separated from one another by unslitted sections of said grid strips, said greater width of said grid strips being parallel to said plane of said grid.

9. The display device of claim 1 that comprises a plurality of juxtaposed display sections each defined by a separate electron diffusion web.

10. The display device of claim 1 wherein said wall and said substrate are substantially rectangular in shape and both are of substantially equal area.

11. The display device of claim 2 wherein said electron diffusion web comprises at least a first series of parallel wires and a second series of parallel wires transverse to said first series.

* * * * *